US009702505B2

(12) United States Patent
Ames et al.

(10) Patent No.: US 9,702,505 B2
(45) Date of Patent: Jul. 11, 2017

(54) CRYOGENIC FLUID CYLINDER

(71) Applicant: Worthington Cylinders Corporation, Worthington, OH (US)

(72) Inventors: Greg Churchill Ames, Worthington, OH (US); James M. Getter, Sunbury, OH (US); Christopher Carl Hall, Dublin, OH (US); Charles T. Hayes, Columbus, OH (US); Michael Thomas Kopczweski, Orient, OH (US); Thomas L. Lease, Westerville, OH (US); Sean Aaron Murray, Powell, OH (US); Jay F. Perkins, Pickerington, OH (US); Adam M. Ruggles, Columbus, OH (US); Rainer Bernhard Teufel, Worthington, OH (US); Joel D. VanGilder, Columbus, OH (US); Igor Ivanovich Zemskov, Columbus, OH (US)

(73) Assignee: Worthington Cylinders Corp., Worthington, OH (US)

( * ) Notice: Subject to any disclaimer, the term of this patent is extended or adjusted under 35 U.S.C. 154(b) by 448 days.

(21) Appl. No.: 14/210,918

(22) Filed: Mar. 14, 2014

(65) Prior Publication Data

US 2015/0013350 A1 Jan. 15, 2015

Related U.S. Application Data

(60) Provisional application No. 61/799,886, filed on Mar. 15, 2013, provisional application No. 61/866,062, filed on Aug. 15, 2013.

(51) Int. Cl.
*F17C 13/00* (2006.01)
*F17C 13/04* (2006.01)
(Continued)

(52) U.S. Cl.
CPC ..... *F17C 5/02* (2013.01); *F17C 1/12* (2013.01); *F17C 3/08* (2013.01); *F17C 5/06* (2013.01);
(Continued)

(58) Field of Classification Search
CPC .... F17C 3/08; F17C 5/02; F17C 13/00; F17C 13/006; F17C 13/028; F17C 13/04;
(Continued)

(56) References Cited

U.S. PATENT DOCUMENTS 2,684,180 A * 7/1954 Allen ..... F16K 13/04 137/68.23
4,715,186 A * 12/1987 Ishimaru ..... F17C 13/085 220/506
(Continued)

OTHER PUBLICATIONS

Safteygram #6 Liquid Oxygen, 900-06-US REV 5/09, 2009, Air Products and Chemicals, Inc., Allentown, PA.
(Continued)

*Primary Examiner* — Ryan J Walters
*Assistant Examiner* — Erik Mendoza-Wilkenfe
(74) *Attorney, Agent, or Firm* — Porter, Wright, Morris & Arthur LLP

(57) ABSTRACT

A cryogenic fluid cylinder includes an inner vessel for holding cryogenic fluid, a cylindrically shaped outer vessel having a vertical longitudinal axis surrounds the inner vessel and forms an insulating space there between, and operating controls located on a top of the outer vessel. Customer or end user operating controls include a liquid-use valve for selectively dispensing liquid cryogen, a pressure-building valve for selectively controlling a pressure building circuit, and a gas-use valve for selectively dispensing cryogen gas. Supplier or maintenance personnel operating controls include an economizer regulator for selectively setting at least one desired pressure of the inner vessel, a vent valve for selec-
(Continued)

tively venting cryogen fluid, and a vacuum pressure port for indicating vacuum pressure between the vessels. The end user controls are located on a front side of the outer vessel while the supplier controls are located on a rear side of the outer vessel.

14 Claims, 10 Drawing Sheets

(51) Int. Cl.

| | |
|---|---|
| ***F17C 5/02*** | (2006.01) |
| ***F17C 3/08*** | (2006.01) |
| ***F17C 5/06*** | (2006.01) |
| ***F17C 9/02*** | (2006.01) |
| ***F17C 13/02*** | (2006.01) |
| ***F17C 1/12*** | (2006.01) |

(52) U.S. Cl.
CPC ..... *F17C 9/02* (2013.01); *F17C 13/021* (2013.01); *F17C 13/025* (2013.01); *F17C 13/04* (2013.01); *F17C 2201/0109* (2013.01); *F17C 2201/032* (2013.01); *F17C 2201/058* (2013.01); *F17C 2203/0391* (2013.01); *F17C 2203/0395* (2013.01); *F17C 2203/0629* (2013.01); *F17C 2203/0643* (2013.01); *F17C 2205/018* (2013.01); *F17C 2205/0165* (2013.01); *F17C 2205/0308* (2013.01); *F17C 2205/0329* (2013.01); *F17C 2205/0338* (2013.01); *F17C 2205/0394* (2013.01); *F17C 2221/011* (2013.01); *F17C 2221/013* (2013.01); *F17C 2221/014* (2013.01); *F17C 2221/016* (2013.01); *F17C 2223/0161* (2013.01); *F17C 2223/033* (2013.01); *F17C 2223/035* (2013.01); *F17C 2223/043* (2013.01); *F17C 2223/046* (2013.01); *F17C 2225/0123* (2013.01); *F17C 2225/035* (2013.01); *F17C 2227/0107* (2013.01); *F17C 2227/0302* (2013.01); *F17C 2227/0381* (2013.01); *F17C 2250/032* (2013.01); *F17C 2250/043* (2013.01); *F17C 2250/0413* (2013.01); *F17C 2250/0491* (2013.01); *F17C 2250/0626* (2013.01); *F17C 2270/05* (2013.01)

(58) Field of Classification Search
CPC ..... F17C 2205/0323; F17C 2205/0326; F17C 2205/0329; F17C 2205/0332; F17C 2205/0335; F17C 2205/0338; F17C 2203/0391; F17C 2205/0165; F25B 2700/19
See application file for complete search history.

(56) References Cited

U.S. PATENT DOCUMENTS

| | | | | | |
|---|---|---|---|---|---|
| 5,152,504 | A * | 10/1992 | Nixon | F16K 1/36 | 251/332 |
| 5,603,869 | A * | 2/1997 | McNew | F02M 3/10 | 137/382 |
| 5,753,148 | A * | 5/1998 | King | F02B 63/02 | 137/382 |
| 5,878,793 | A * | 3/1999 | Siegele | B01J 4/00 | 141/198 |
| 6,234,458 | B1 * | 5/2001 | Gerhardy | F02B 63/02 | 261/71 |
| 6,276,143 | B1 * | 8/2001 | Wimberley | F17C 7/02 | 62/50.2 |
| 6,505,469 | B1 * | 1/2003 | Drube | F17C 7/04 | 62/48.1 |
| 6,742,517 | B1 * | 6/2004 | Frye | F17C 7/02 | 128/201.21 |
| 6,946,920 | B1 * | 9/2005 | Williams | H03L 7/00 | 327/159 |
| 2008/0232927 | A1 * | 9/2008 | Trimble | F16B 37/14 | 411/429 |
| 2010/0147859 | A1 * | 6/2010 | Chohfi | F17C 1/14 | 220/581 |
| 2011/0049194 | A1 * | 3/2011 | Cannet | F17C 13/04 | 137/382 |
| 2011/0108751 | A1 * | 5/2011 | Hamm | G05D 16/0663 | 251/321 |
| 2012/0152384 | A1 * | 6/2012 | Beswick | G05D 16/0602 | 137/613 |
| 2013/0282310 | A1 * | 10/2013 | Cardinale | G01L 27/005 | 702/53 |

OTHER PUBLICATIONS

Cryogenic Liquid Cylinder Operating Manual 180HP-200HP-265HP, undated, Cyl-Tec Inc., Aurora, IL.
Dura-Cyl Premium Liquid Cylinders—Footring, P/N 14338395, 2009, Chart Inc., Garfield Heights, OH.
Instructions for XL-160 and XL-180, TW-72, undated, Taylor-Wharton. Theodore, AL.

* cited by examiner

CRYOGENIC FLUID CYLINDER

CROSS-REFERENCE TO RELATED APPLICATIONS

This application claims the priority benefit of U.S. Provisional Patent Application No. 61/799,886 filed on Mar. 15, 2013 and U.S. Provisional Patent Application No. 61/866,062 filed on Aug. 15, 2013, the disclosures of which are expressly incorporated herein in their entireties by reference.

STATEMENT REGARDING FEDERALLY SPONSORED RESEARCH

Not Applicable

PARTIES TO A JOINT RESEARCH AGREEMENT

Not Applicable

REFERENCE TO APPENDIX

Not Applicable

FIELD OF THE INVENTION

The field of the present invention relates to storage vessels for cryogenic fluids, and more particularly, to vertically-oriented cylinders for holding cryogenic fluids.

BACKGROUND OF THE INVENTION

A typical cryogenic fluid storage vessel or container includes an inner tank for retaining a supply of cryogenic liquid and an outer jacket surrounding the inner tank. The outer jacket is spaced from the inner tank to create an insulation chamber there between. The insulation chamber typically has a vacuum created therein. Thus, the storage container is configured to reduce radiant and conductive heat transfer between the tanks in order to reduce vaporization of the cryogenic liquid stored in the inner tank.

While prior cryogenic fluid storage containers may perform in an adequate manner to store cryogenic fluids, they are not easy to maintain in a working manner over time, can be difficult to operate, and can be difficult to move or transport. This is particularly true for vertically oriented cryogenic fluid cylinders. Accordingly, there is a need for improved cryogenic fluid containers.

SUMMARY OF THE INVENTION

Disclosed herein are cryogenic fluid storage vessels or containers which overcome at least one of the deficiencies of the prior art. Disclosed is a cryogenic fluid container comprising, in combination, an inner vessel for holding cryogenic fluid, a cylindrically shaped outer vessel having a vertically extending central longitudinal axis and surrounding the inner vessel and forming an insulating space therebetween, and end user operating controls located on a top of the outer vessel including a liquid-use valve for selectively dispensing liquid cryogen from the inner vessel, a pressure-building valve for selectively controlling a pressure building circuit for increasing pressure within the inner vessel, a gas-use valve for selectively dispensing gaseous cryogen from the inner vessel. Each of the end user operating controls are located on a front side of the top of the outer vessel.

Also disclosed is a vertically-oriented cryogenic fluid cylinder comprising, in combination, an inner vessel for holding cryogenic fluid, a cylindrically shaped outer vessel having a vertically extending central longitudinal axis and surrounding the inner vessel and forming an insulating space therebetween, operating controls located on a top of the outer vessel, and a handling ring secured to the top of the outer vessel and encircling the operating controls. The handling ring has at least one raised portion for providing additional access beneath the handling ring to at least some of the operating controls while protecting the operating controls.

Also disclosed is a cryogenic fluid container comprising, in combination, an inner vessel for holding cryogenic fluid, a cylindrically shaped outer vessel having a vertically extending central longitudinal axis and surrounding the inner vessel and forming an insulating space therebetween, operating controls located on a top of the outer vessel including an economizer regulator having an adjustment screw for selectively setting at least one pressure level, and a protective cap covering only a portion of the adjustment screw and configured to prevent the adjustment screw from being rotated to adjust the at least one pressure level.

Also disclosed is a cryogenic fluid container comprising, in combination, an inner vessel for holding cryogenic fluid, a cylindrically shaped outer vessel having a vertically extending central longitudinal axis and surrounding the inner vessel and forming an insulating space therebetween, operating controls located on a top of the outer vessel, and a pump-out port located in a wall of the outer vessel. The pump out port includes a base secured to the outer vessel and having a passage connecting an interior space of the outer vessel with atmosphere about the outer vessel and a plug sealing the passage and configured to be released from the passage at a predetermined pressure within the outer vessel. The plug comprises a material which resists galling with the base.

Also disclosed is a cryogenic fluid container comprising, in combination, an inner vessel for holding cryogenic fluid, a cylindrically shaped outer vessel having a vertically extending central longitudinal axis and surrounding the inner vessel and forming an insulating space therebetween, operating controls located on a top of the outer vessel, and a vacuum gauge port assembly located in a wall of the outer vessel. The vacuum gauge port assembly includes a receptacle secured to the wall of outer vessel and having an interior cavity and a digital vacuum sensor secured within the interior cavity of the receptacle and having an electrical connector for removable connection of an external vacuum gage for indicating vacuum within the outer vessel. The sensor is exposed to vacuum within the outer vessel through an opening in the receptacle.

From the foregoing disclosure and the following more detailed description of various preferred embodiments it will be apparent to those skilled in the art that the present invention provides a significant advance in the technology and art of cryogenic fluid containers. Particularly significant in this regard is the potential the invention affords for providing reliable and relatively low cost cryogenic fluid container that is relatively easy to use, maintain, and transport. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
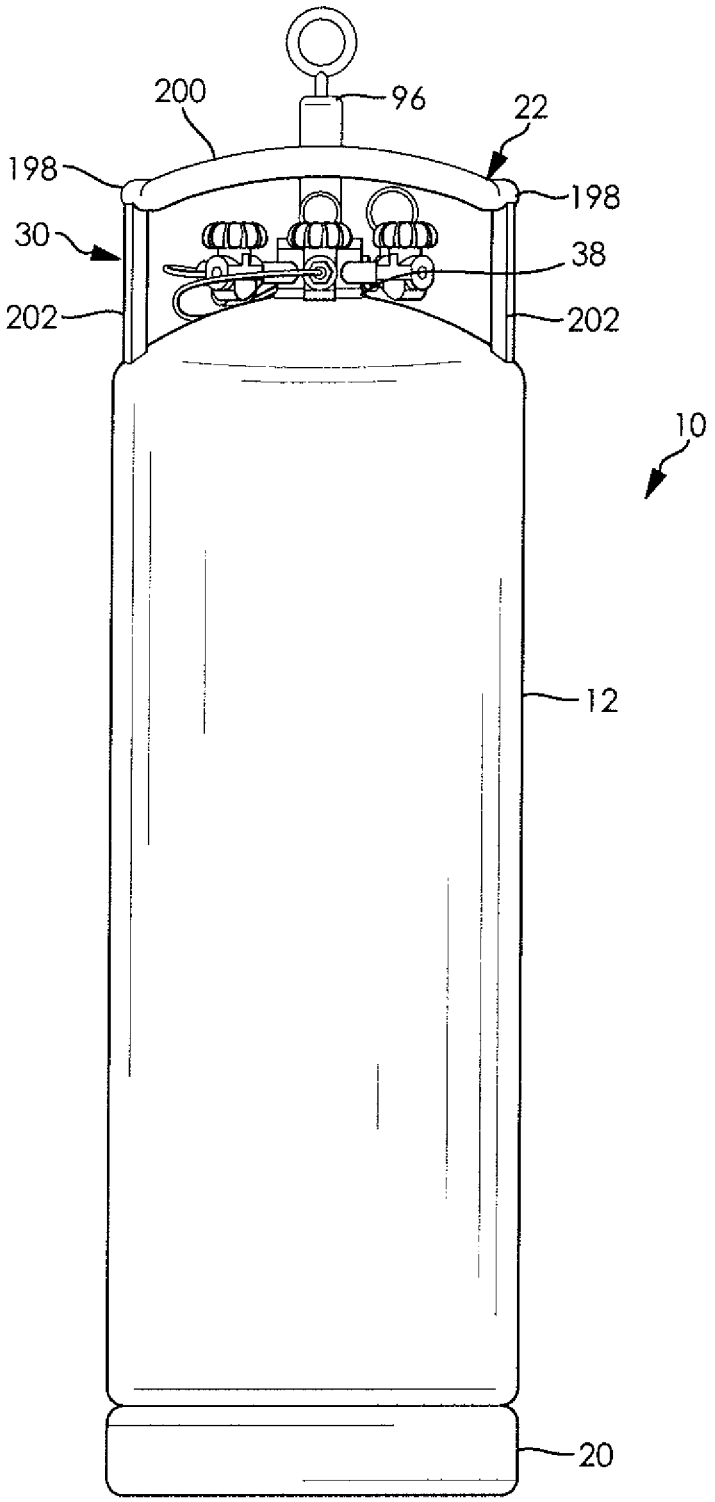
FIG. 1 is a front elevational view of a vertically-oriented cryogenic fluid cylinder according to the present invention.

It should be understood that the appended drawings are not necessarily to scale, presenting a somewhat simplified representation of various preferred features illustrative of the basic principles of the invention. The specific design features of the cryogenic fluid storage containers as disclosed herein, including, for example, specific dimensions, orientations, locations, and shapes of the various components, will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the cryogenic fluid storage containers illustrated in the drawings.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved cryogenic fluid storage containers disclosed herein. The following detailed discussion of various alternative and preferred embodiments will illustrate the general principles of the invention with regard to a vertically-oriented cryogenic fluid cylinder 10. Other embodiments suitable for other applications will be apparent to those skilled in the art given the benefit of this disclosure.

Referring now to the drawings, FIGS. 1 to 4 illustrate a cryogenic fluid storage container in the form of a vertically-oriented cryogenic fluid cylinder 10 according to the present invention. The cryogenic fluid cylinder 10 is designed for the storage and transportation of cryogenic liquids such as, for example, liquid nitrogen, liquid oxygen, liquid argon, liquid carbon dioxide, liquid nitrous oxide, and the like. The illustrated cryogenic fluid cylinder 10 includes a cylindrically-shaped outer vessel or tank 12 having a vertically extending central longitudinal axis 14 perpendicular to a diameter of the outer vessel 12, an inner vessel or tank 16 located within the outer vessel 12 having a vertically extending central longitudinal axis 18 perpendicular to a diameter of the inner vessel 16 and coaxial with the longitudinal axis 14 of the outer vessel 12, a foot ring 20 secured to the bottom of the outer vessel 12, and a handling or protective ring 22 secured to the top of the outer vessel 12. The illustrated outer and inner vessels 12, 16 have elongate longitudinal lengths such that the lengths of the vessels 12, 16 are about 2.5 to 3.0 times larger than the diameters of the vessels 12, 16 but any other suitable size can alternatively be utilized. The outer and inner vessels 12, 16, the foot ring 20, and the handling ring 22 preferably comprise stainless steel but any other suitable material can alternatively be utilized. The inner vessel 16 has a hollow interior space 24 for containing the cryogenic fluid and is supported within the outer vessel 12 to minimize heat communication between the vessels 12, 16 while providing adequate support of the inner vessel 16. The illustrated inner vessel 16 is at least partially supported by a support tube 26 extending from the top of the outer vessel 12 to the top of the inner vessel 16 within the outer vessel 12 and communicating an opening 12*a* in the top of the outer vessel 12 with an opening 16*a* in the top of the inner vessel 16. Vacuum is present in a gap or space 28 between the vessels 12, 16. Additionally, cryogenic thermal insulation and/or vacuum getters can be provided in the space 28 to assist thermally insulating the inner vessel 16.

Figure 2:
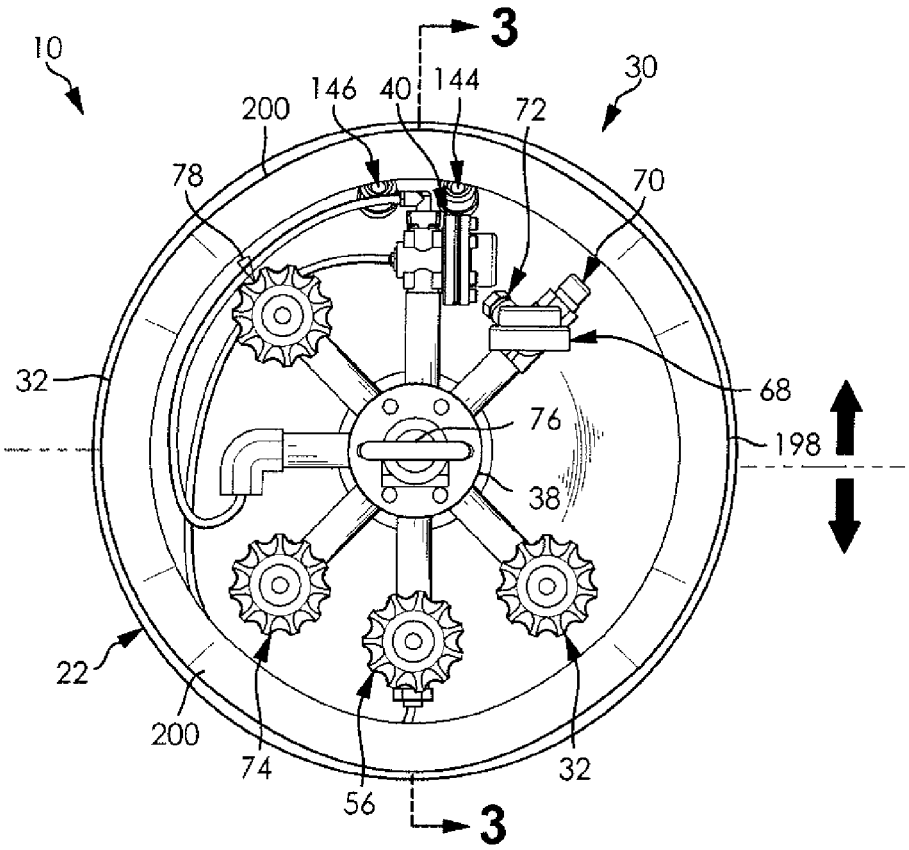
FIG. 2 is a diagrammatic view of the top of the cryogenic fluid cylinder of FIG. 1 showing user controls and wherein a central lifting lug is remove for clarity.

As best shown in FIG. 2, all operating controls 30 of the illustrated cryogenic fluid cylinder 10 are located at the top of the outer vessel 12. The operating controls 30 enable suppliers or maintenance personnel and customers or end users to control operations of the cryogenic fluid cylinder 10.

Figure 5:
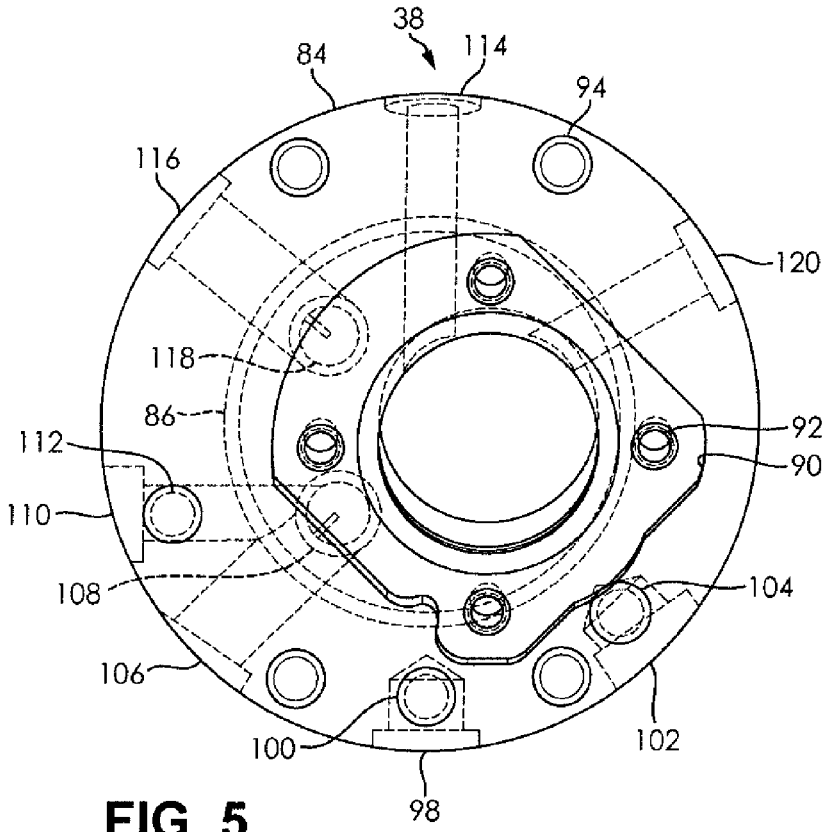
FIG. 5 is a top plan view of a manifold of the cryogenic fluid cylinder of FIGS. 1 to 4.
Figure 6:
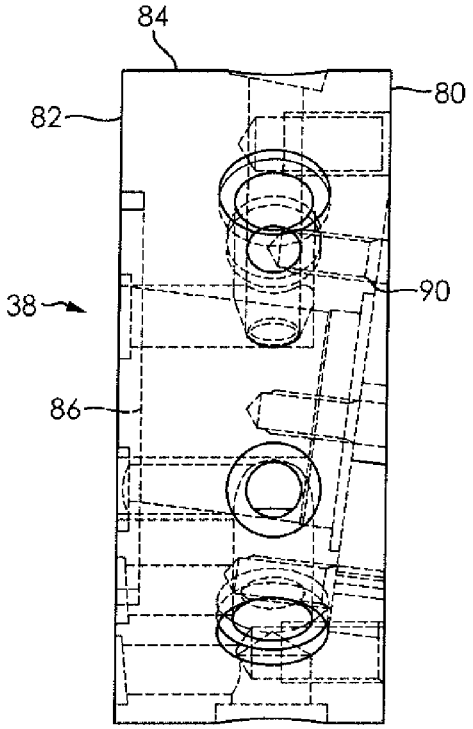
FIG. 6 is a right side view of the manifold of FIG. 5.
Figure 7:
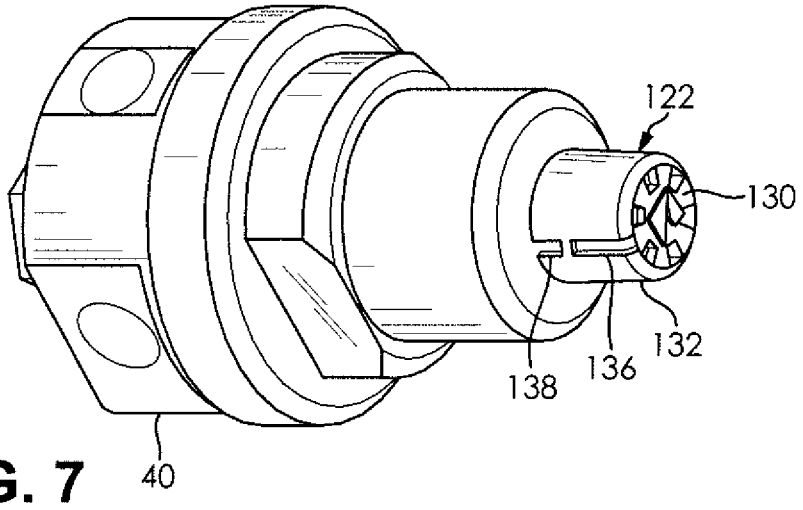
FIG. 7 is a perspective view of an economizer regulator of the cryogenic fluid cylinder of FIGS. 1 to 4 having a protective cap secured thereto.
Figure 8:
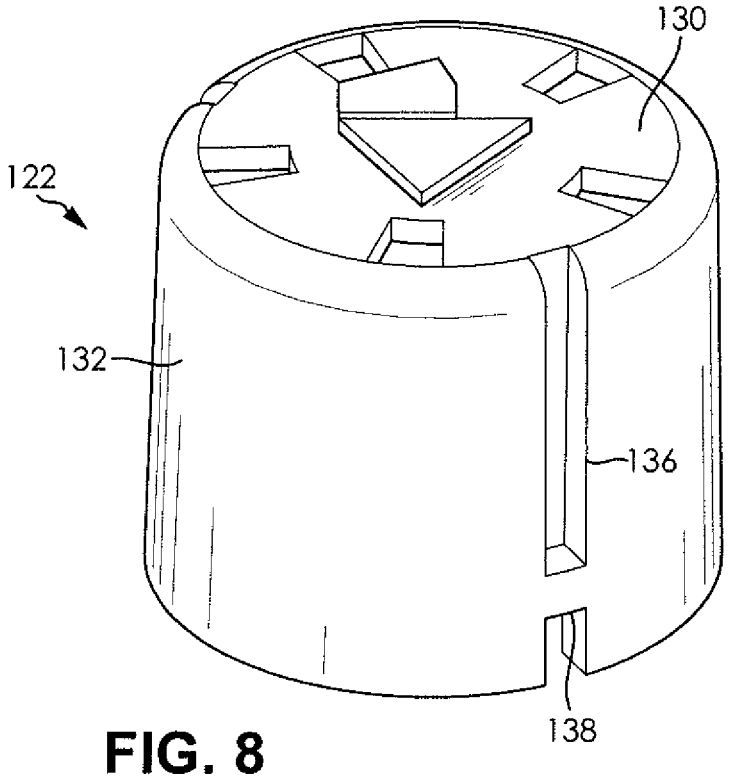
FIG. 8 is an enlarged perspective view of the economizer regulator protective cap of FIG. 7.
Figure 9:
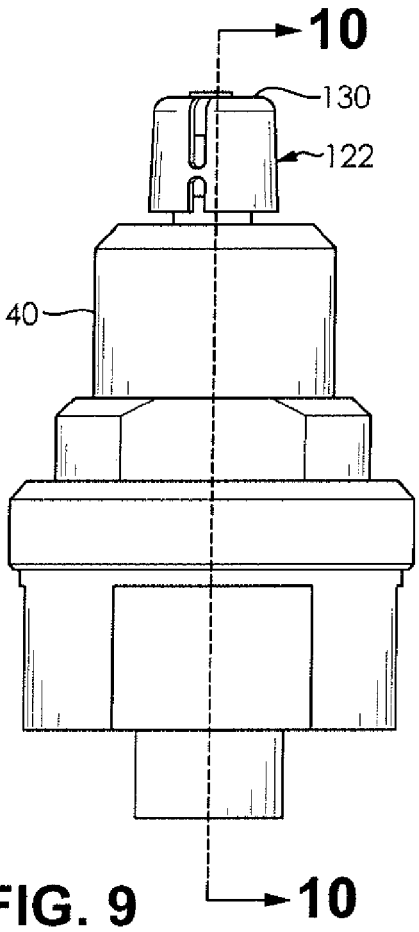
FIG. 9 is a side view of the economizer regulator of FIG. 7.
Figure 10:
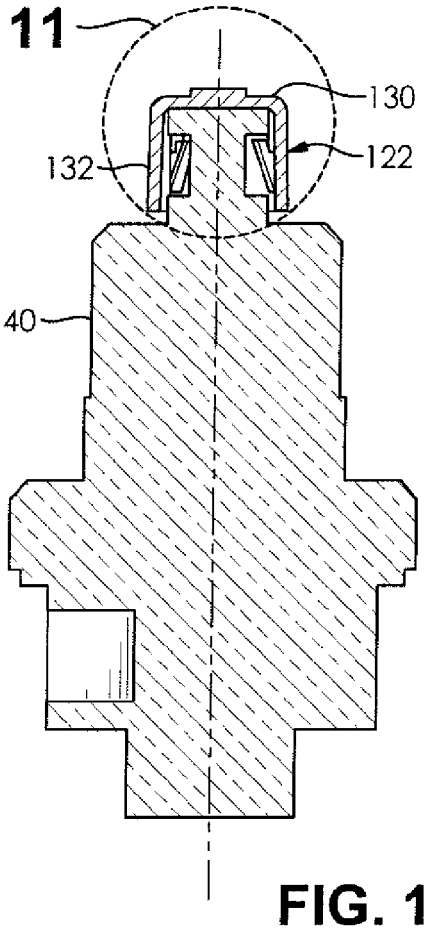
FIG. 10 is a is cross-sectional view of the economizer regulator taken along line 10-10 of FIG. 9.
Figure 11:
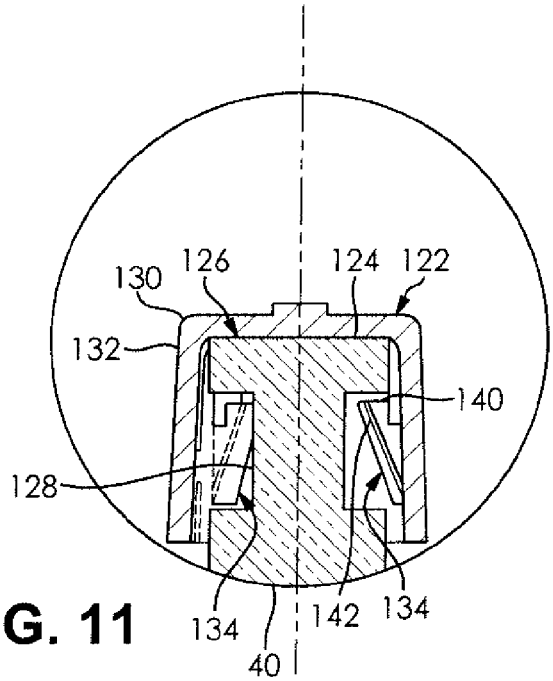
FIG. 11 is an enlarged fragmented view taken from FIG. 10 showing an interface between the economizer regulator and the protective cap.

A manually-operable gas-use valve 32 is located at the top of the outer vessel 12 and is in communication with a vaporizer coil 34 of an economizer circuit 36 through a manifold or "knuckle" 38 (best shown in FIGS. 5 and 6). The manifold 38 is located outside the outer vessel 12 and is secured to the outer vessel 12 at the top opening 12*a*. The manifold 38 closes and seals the opening 12*a* in the outer vessel 12 except for the passages therein as discussed in more detail hereinafter. The gas-use valve 32 has an outlet and an inlet and has a manually operable turn handle to open and close the gas-use valve 32. The gas-use valve 32 is opened and closed by the end users to selectively supply pressurized cryogenic gas from the cryogenic fluid cylinder 10 to an external device. The outlet of gas-use valve 32 is provided with a suitable fitting for attachment of a gas supply line for connecting the gas-use valve 32 with the external device to be supplied with the cryogenic gas.

An economizer or control regulator 40 is located at the top of the outer vessel 12 for regulating the economizer circuit 36 and a pressure building circuit 42 to automatically maintain desired operating pressures within the inner vessel 12. The economizer regulator 40 is in fluid flow communication with an upper portion of the inner vessel 16 via a regulator port 44 of the manifold 38. An economizer portion 46 of the economizer regulator 40 is also in fluid flow communication with an economizer tube 48 extending to the vaporizer 50 of the economizer circuit 36 via an economizer port 52 of the manifold 38. The illustrated economizer regulator 40 is connected to the economizer port 52 with external copper tubing 54 but any other suitable connection can alternatively be utilized. The economizer regulator 40 is also in fluid flow communication with a manually-operable pressure building valve 56 which is connected to the pressure building coil 58 of the pressure building circuit 42. The illustrated economizer regulator 40 is connected to the pressure build valve 56 with external copper tubing 60 but any other suitable connection can alternatively be utilized. The economizer regulator 40 is typically adjusted by the suppliers or maintenance personnel to set an economizer pressure and a pressure building pressure. The illustrated economizer regulator 40 automatically sets the economizer setting a predetermined amount higher than the pressure building setting such as, for example, about 15, psig.

When it is desired to release pressurized cryogenic gas from the inner vessel 16, the customers or end-users open the gas-use valve 32. If the operating pressure within the inner vessel 16 is greater than the economizer setting of the economizer regulator 40, the regulator 40 is automatically open to communicate the head space 24*a* within the inner vessel 16 with the economizer 62 of the economizer circuit 36 so that pressurized cryogenic gas flows from the head space 24*a* within the inner vessel 16 to the economizer regulator 40 through the manifold 38, from the economizer regulator 40 to the economizer tube 48 through the manifold 38, through the vaporizer 50 within the outer vessel 12, from the vaporizer 50 to the gas-use valve 32 through the manifold 38, and through the gas-use valve 32 for delivery to the external device through the gas supply line secured between the gas-use valve 32 and the external device. As pressurized cryogenic gas is released, the operating pressure within the inner vessel 16 is reduced. If the operating pressure within the inner vessel 16 drops to the economizer setting of the economizer regulator 40, the economizer regulator 40 is automatically closed and cryogenic liquid flows up the liquid tube 64 from the bottom of the inner vessel 16 to the economizer tube 48 via the manifold 38, through the vaporizer 50 within the outer vessel 12 where it is vaporized, from the vaporizer 50 to the gas-use valve 32 through the manifold 38, and through the gas-use valve 32 for delivery to the external device through the gas supply line secured between the gas-use valve 32 and the external device. If the operating pressure within the inner vessel 16 drops to the pressure building setting of the economizer regulator 40, the economizer regulator 40 automatically opens to connect the pressure building valve 56 with the head space 24*a* within the inner vessel 16 so that, when the pressure building valve 56 is open, cryogen liquid flows from the bottom of the inner vessel 16 to the pressure building coil 58, through the pressure building coil 58 within the outer vessel 12 where it is vaporized, from the pressure building coil 58 to the pressure building valve 56 through the manifold 38, from the pressure building valve 56 to the economizer regulator 40, and from the economizer regulator 40 to the head space 24*a* with the inner vessel 16 through the manifold 38. When the operating pressure within the inner vessel 16 rises about the pressure build setting of the economizer regulator 40, the economizer regulator 40 closes to stop flow through the pressure building circuit 42. It is noted that the illustrated vaporizer coil 34 and pressure building coil 58 are located between the outer and inner vessels 12, 16 and attached to the inside of the outer vessel 12. When it is desired to stop release of the cryogenic gas from the cryogenic fluid cylinder 10, the customer or end user closes the gas use valve 32.

The manually-operable pressure building valve 56 is located at the top of the outer vessel 12 and can be selectively operated to isolate the economizer regulator 40 from the pressure building coil 58. The pressure building valve 56 has an outlet and an inlet and has a manually operable turn handle to open and close the pressure building valve 56. The pressure building valve 56 is in fluid flow communication with an outlet of the pressure building coil 56 and is in fluid flow communication with the pressure building portion 66 of the economizer regulator 40. When the pressure building valve 56 is open, the pressure building circuit 42 automatically operates as described above to raise the operating pressure within the inner vessel 16. When the pressure building valve 56 is closed, the pressure building circuit 42 does not operate.

A pressure gauge 68 is located at the top of the outer vessel 12 and is in fluid flow communication with the head space 24*a* of the inner vessel 16 through the manifold 38. The pressure gauge 68 displays the current operating pressure within the inner vessel 16. The illustrated pressure gauge 68 is a mechanical dial gauge but it is noted that any other suitable type of pressure gauge can alternatively be utilized.

A pressure relief device or valve 70 is located at the top of the outer vessel 12 and is in fluid flow communication with the head space 24*a* within the inner vessel 16 through the manifold 38. The pressure relief valve 70 automatically opens when the operating pressure within the inner vessel 16 reaches a predetermined maximum operating pressure. When open, the pressure relief valve 70 vents cryogenic gas from the inner vessel 16 to atmosphere via the manifold 38. A burst device or disc 72 is also located at the top of the outer vessel 12 and is in fluid flow communication with the head space 24*a* within the inner vessel 16 through the manifold 38. The burst disc 72 ruptures to release excess pressure at a predetermined maximum pressure greater than the predetermined maximum pressure of the pressure release device 70 and indicating that the pressure relief device 70 failed to properly operate. When ruptured, the burst disc 72 vents cryogenic gas from the inner vessel 16 to atmosphere through the manifold 38. The pressure relief device 70 and the burst device 72 can be of any suitable type.

A manually-operable liquid-use valve 74 is located at the top of the outer vessel 12 and is in fluid flow communication with the outlet of liquid withdrawal tube 64 located within the inner vessel 16 through the manifold 38. The liquid-use valve 74 has an outlet and an inlet and has a manually operable turn handle to open and close the liquid-use valve 74. The liquid-use valve 74 is opened and closed by the customer or end user to selectively supply cryogenic liquid from the inner vessel 16 to an external device. The liquid-use valve is provided with a suitable fitting for attachment of a liquid supply line for connecting the liquid-use valve 72 with the external device to be supplied with the cryogenic liquid.

A liquid level gauge 76 is mounted at the top of the outer vessel 12 to the manifold 38 and extends into the inner vessel 16 through the manifold 38 to indicate the level of the cryogenic liquid within the inner vessel 16. The illustrated liquid level indicator 76 is a float or swing arm type of liquid level gauge and has a mechanical dial but it is noted that any other suitable type of liquid level gauge and/or dial can alternatively be utilized.

A manually-operable vent valve 78 is located at the top of the outer vessel 12 and is in fluid flow communication with the inner vessel 16 through the manifold 38. The vent valve 78 has an outlet and an inlet and has a manually operable turn handle to open and close the vent valve 78. The vent valve 78 is opened and closed by maintenance personnel to control liquid filling and/or gas withdrawal. The vent valve 78 is provided with a suitable fitting for attachment of a transfer or vent line.

As best shown in FIGS. 5 and 6, the illustrated manifold 38 is cylindrical shaped having a planar upper surface 80, a planar lower surface 82 opposite the upper surface 80 and a circular peripheral side surface 84 connecting the upper and lower surfaces 80, 82. The manifold 38 is sized and shaped to be secured to the top of the outer vessel 12 and closing and sealing the opening 12*a* in the top of the outer vessel 12. The lower surface 82 is provided with a counter bore 86 for receiving the support tube 26 for the inner vessel 16. A main passage 88 extends through the manifold 38 from the upper surface 80 to the lower surface 82 within the counter bore 86 on the lower surface so that when the support tube 26 is secured between the inner vessel 16 and the manifold 38, the passage is in fluid flow communication with the head space 24*a* of the inner vessel 16. The illustrated upper surface 80 is provided with a counter bore or cavity 90 about the passage 88 as well as a plurality of spaced-apart threaded fastener openings 92 for securing the liquid level gauge 76 thereto that closes and seals the upper end of the passage 88. The illustrated upper surface 80 is also provided with a plurality of spaced-apart fastener openings 94 for securing a central lifting lug 96 thereto (best shown in FIG. 1).

The front of the illustrated manifold side surface 84 is provided with a pressure building port 98 for connection of the pressure building valve 56. The pressure building port 98 is connected for fluid flow communication, via an internal passage, to a pressure building coil port 100 on the lower surface 82, outside the support tube counter bore 86, for connection of the outlet of the pressure building coil 58 located within the outer vessel 16. Adjacent to the pressure building port 98, the front of the illustrated manifold side surface 84 is provided with a gas port 102 for connection of the gas-use valve 32. The gas port 102 is connected for fluid flow communication, via an internal passage, to a vaporizer outlet port 104 on the lower surface 82, outside the support tube counter bore 86, for connection of the outlet of the vaporizer coil 34 located within the outer vessel 12. Adjacent to the pressure building port 98 opposite the gas port 102, the front of the illustrated manifold side surface 84 is provided with a liquid port 106 for connection of the liquid-use valve 74. The liquid port 106 is connected for fluid flow communication, via an internal passage, to a withdrawal tube port 108 on the lower surface 82, within the support tube counter bore 86, for connection of the outlet of the liquid withdrawal tube 64 located within the inner vessel 16. Adjacent to the liquid use port 106 opposite the pressure building port 98, the front of the illustrated manifold side surface 84 is provided with an economizer tube port 110 for connection of the economizer portion 46 of the economizer regulator 40. The economizer tube port 110 is connected for fluid flow communication, via an internal passage, to a vaporizer inlet port 112 on the lower surface 82, outside the support tube counter bore 86, for connection of the inlet of the economizer tube 48 located within the outer vessel 12. It is noted that the inner passage also connects the economizer tube port 110 in fluid flow communication with the withdrawal tube port 108. Thus, the liquid port 106 and the withdrawal tube port 108 are each in fluid flow communication with each of the economizer tube port 110 and the vaporizer inlet port 112.

The rear of the illustrated manifold side surface 84 is provided with a pressure building regulator port 114 for connection of the economizer regulator 40. The pressure regulator port 114 is connected for fluid flow communication, via an internal passage, to the main passage 88 and thus the head space 24*a* of the inner vessel 16. Adjacent to the regulator port 114, the rear of the illustrated manifold side surface 84 is provided with a vent port 116 for connection of the vent valve 78. The vent port 116 is connected for fluid flow communication, via an internal passage, to a port 118 on the lower surface, within the support tube counter bore, 86 to be in fluid flow communication with the head space 24*a* of the inner vessel 16. Adjacent to the regulator port 114 opposite the vent port 116, the rear of the illustrated manifold side surface 84 is provided with a relief port 120 for connection of the pressure gauge 68, the pressure relief device 70, and the burst disc 72. The relief port 120 is connected for fluid flow communication, via an internal passage, to the main passage 88 and thus the head space 24*a* of the inner vessel 16. It is noted that the manifold 38 can alternatively have any other suitable configuration.

FIGS. 7 to 11 illustrate a protective cover or cap 122 secured to the economizer regulator 40. The illustrated protective cover 122 is sized and shaped to cover a head portion 124 of an adjustment screw or bolt 126 and an adjacent portion 128 of the adjustment screw 126 that is otherwise exposed outside the economizer regulator 40. The adjustment screw 126 is rotatable about its longitudinal axis to selectively adjust the pressure set points of the economizer regulator 40. The illustrated protective cover 122 is generally cup-shaped having a planar end wall 130 and a cylindrically-shaped side wall 132 extending from the end wall 130 to form an interior space with a closed end and an open end opposed to the open end. The interior space is sized and shaped to receive the exposed portion of the adjustment screw of the economizer regulator therein. A plurality of circumferentially spaced-apart detents or protrusions are provide within the interior space that form a one-way snap lock onto the head portion 124 of the adjustment screw 126. That is, the protective cover 122 can be snapped onto the screw head 124 so that it is secured thereto but cannot be removed from the head portion 124 of the adjustment screw 126 without breaking or damaging the protective cover 122. The head 124 of the adjustment screw 126 retains the protective cap 122 on the adjustment screw 126. It is noted that the illustrated protective cap 122 only covers a portion of the adjustment screw 126 so that the remainder of the economizer regulator 40 remains exposed for inspection.

The illustrated protective cap 122 has a pair of longitudinally extending slots 136 on opposite sides of the side wall 132. The illustrated slots 136 each have a small connecting web 138 that holds the side wall 132 in its circular shape. If it is desired to remove the protective cap 122 from the adjustment screw 126, the relatively small webs 138 can be easily cut to release the protective cap 122 from the adjustment screw 126. With the webs 130 cut, the side wall 132 can be pivoted back to remove the interference between the head 124 of the adjustment screw 126 and the engagement surfaces 140 of the protective cap 126. The webs 138 can be easily cut with a knife, scissors, or the like. Once cut, the protective cap 122 can be discarded and a new one is used in its place after adjusting the adjustment screw 126. It is noted that the protective cover 122 could alternatively be configured so that it is removable with a special removal tool.

The illustrated detents each inwardly extend from inner side of the side wall 132 within the interior space and have a rearward-facing planar engagement 140 surface that faces and is generally parallel with the end wall 130. The illustrated detents also each have an inward facing camming surface 142 that extend radially inwardly in a direction toward the end wall 130. The detents are secured to the side wall 132 toward their outer ends so that the rearward end forming the engagement surface 140 is resiliently deflectable in a radially outward direction toward the side wall 132. The protective caps 122 are preferably molded of a plastic material providing the desired resilient deflection but can alternatively be formed of any other suitable material.

Configured in this manner, the protective cap 122 is installed by moving the open end of the cap 122 over the head portion 124 of the adjustment screw 126 in the longitudinal direction. When the angled camming surfaces 142 engage the head portion 124, the detents are deflected radially outwardly so that the detents pass over the head portion 124 as the protective cap 122 continues to move in the forward direction. When the detents are past the head portion 124, the detents resiliently snap back to their at rest (or undeflected) positions. Once placed in this position, the protective cap 122 cannot be removed because the engagement surfaces 140 engage the head portion 124 to prevent further withdrawal. Also, the open end of the cap 122 is blocked by the economizer regulator 40 so that there is not adequate access to the detents to manually defect them outwardly out of the path of the head portion 124 of the adjustment screw 126. It is noted that the protective cover 122 is sized and shaped so that it freely rotates about the adjustment screw 126 when secured thereto. Thus, rotation of the protective cover 122 will not rotate the adjustment screw 126. The illustrated protective cover 122 is installed onto the adjustment screw 126 of the economizer regulator 40 by supplier or maintenance personnel after the economizer regulator 40 has been adjusted to the desired pressure set points. Typically, this is done at the time the cryogenic fluid cylinder 10 is filled with cryogenic liquid. With the protective cover 122 in place, end users or others cannot adjust the pressure set points because the adjustment screw 126 cannot be rotated. If the protective cover 122 is damaged or removed, it is a sign that the pressure set points may have been altered. When the cryogenic fluid cylinder 10 is to be refilled with cryogenic fluid or other maintenance is to be performed requiring adjustment of the economizer regulator 40, the protective cap 122 is cut and removed and a new protective cap 122 is installed at the appropriate time.

Figure 12:
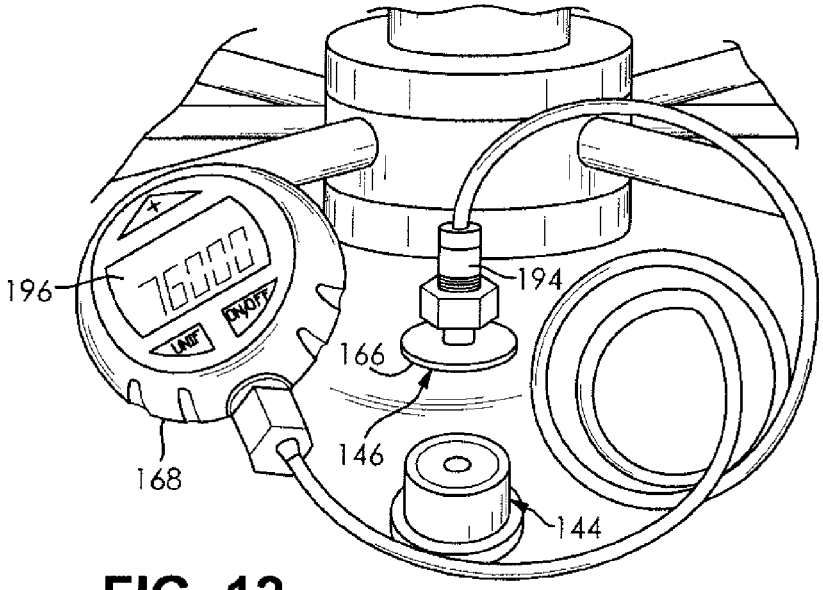
FIG. 12 is an enlarged perspective view of a top portion of the cryogenic fluid cylinder of FIGS. 1 to 4 showing an outer vessel pump-out plug and an outer vessel digital vacuum gauge assembly.

As best shown in FIG. 12, the top of the outer vessel 12 is also provided with a pump-out or seal plug 144 and a vacuum gauge assembly 146. The pump-out or seal plug 144 protects the outer vessel 12 from over pressurization. The vacuum gauge assembly 146 provides supplier or maintenance personnel an indication of the pressure or vacuum between the outer and inner vessels 12, 16.

Figure 13:
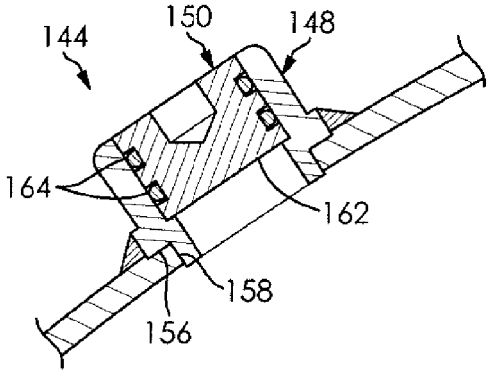
FIG. 13 is a cross sectional view showing the outer vessel pump-out plug of FIG. 12.
Figure 14:
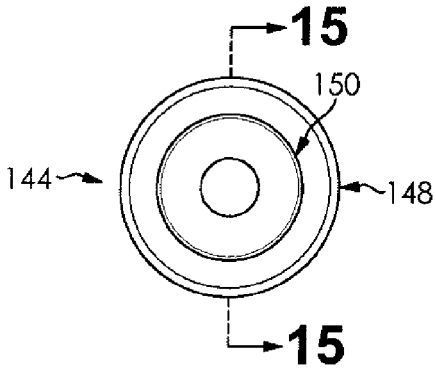
FIG. 14 is a top plan view of the of the outer vessel pump-out plug of FIGS. 12 and 13.
Figure 15:
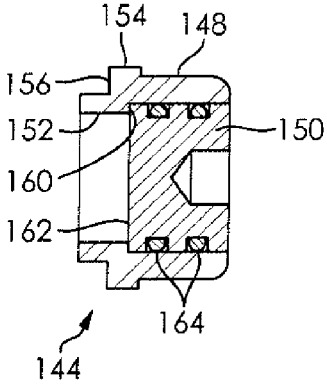
FIG. 15 is a cross-section view of the outer vessel pump-out plug taken along line 15-15 of FIG. 14.
Figure 16:
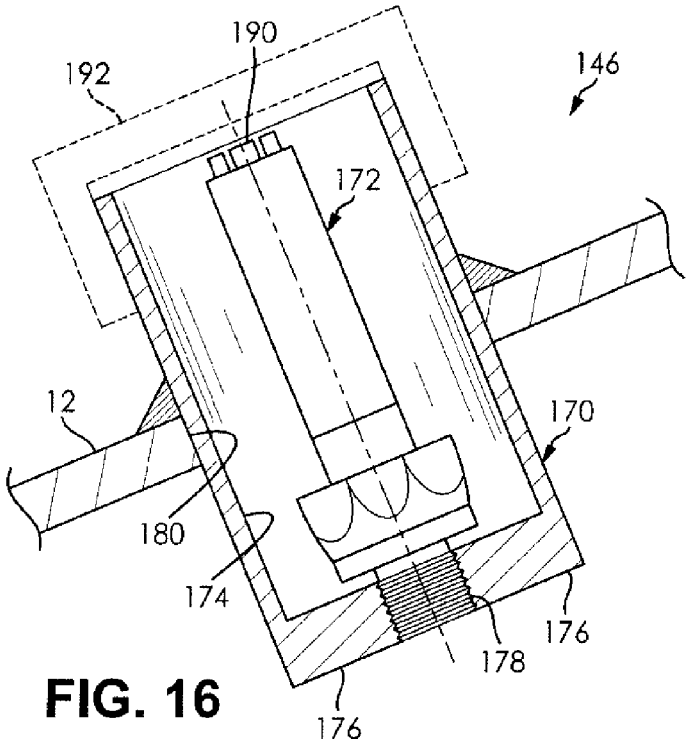
FIG. 16 is a cross sectional view showing a terminal assembly of the outer vessel digital vacuum gauge assembly of FIG. 12 wherein a digital reader or display has be disconnected.

The illustrated pump-out plug 144 is secured through the outer vessel 12 at the rear side of the top of the cryogenic fluid cylinder 10. As best shown in FIGS. 13 to 15, the illustrated pump-out plug 144 includes a base 148 and a plug 150. The illustrated base 148 is generally cylindrical shaped having a central passage 152 therethrough. An outer surface of the base is provided with a flange 154 having a bottom surface 156 that engages the outer surface of the outer vessel 12 when the lower end of the base 148 is inserted into an opening 158 in the outer vessel 12. The illustrated base 148 is welded to the outer vessel 12 but the base 148 can alternatively be secured in any other suitable manner or formed integral with the outer vessel 12. The illustrated base 148 is formed of stainless steel which can be suitably welded to the stainless steel outer vessel 12 but any other suitable material can alternatively be utilized. An inner surface of the base 148 is provided with an outward facing abutment 160 that is engages by the plug 150 to limit inward movement of the plug 150 through the base 148.

The illustrated plug 150 is cylindrical shaped for receipt in the passage 152 of the base 148 with a lower end 162 of the plug 150 engaged with the abutment 160 of the base 148. The illustrated outer surface of the plug 150 is provided with a pair of circumferentially extending and longitudinally spaced apart o-rings 164. The base 148, the plug 150, and the o-rings 164 are configured so that the plug 150 remains in the base 148 and seals the opening 158 in the outer vessel 12 over a predetermined range of pressures within the outer vessel 12 but the plug 150 is released or pushed out of the base 148 at a predetermined pressure to prevent rupture of the outer vessel 12. The illustrated plug 150 is formed of brass but any other suitable material can alternatively utilized.

The illustrated plug 150 comprises brass to prevent galling between the plug 150 and the base 148. Galling is a problem because the metal plug 150 must slide while in tight contact with the metal base 148. Galling can occur regardless of whether the metals are the same or different. Galling is a form of wear caused by adhesion between sliding surfaces. When a material galls, some of it is pulled with the contacting surface, especially if there is a large amount of force compressing the surfaces together. This will generally leave some material stuck or even friction welded to the adjacent surface, while the galled material may appear gouged with balled-up or torn lumps of material stuck to its surface. This can cause the plug 150 to fail to be pushed out of the base 148 at the predetermined pressure which can result in a catastrophic failure of the outer vessel 12. Brass is utilized for forming the plug 150 because of its resistance to galling but any other material highly resistant to galling can alternatively be utilized such as, for example, materials having a face-centered-cubic structure (copper, bronze, gold), hexagonal close packed structures (cobalt based alloys), and the like. It is noted that the plug 150 can alternatively or additionally be provided with an outer coating of a such a material or alloy.

The illustrated vacuum gauge assembly 146 is secured through the outer vessel 12 at the rear side of the top of the cryogenic fluid cylinder 10. The illustrated vacuum gauge assembly 146 includes a vacuum gauge port assembly 166 and an external vacuum gauge reader or display 168 removably securable to the vacuum gauge port assembly 166. As best shown in FIGS. 16 to 22, the vacuum gauge port assembly 166 includes a receptacle 170 and a digital vacuum sensor 172 secured to the receptacle 170. The illustrated vacuum gauge port assembly 166 provides a leak tight mechanical connection and sensor feed through so that the vacuum level in the insulation chamber or space 28 between the outer and inner vessels 12, 16 can be checked and/or determined.

Figure 17:
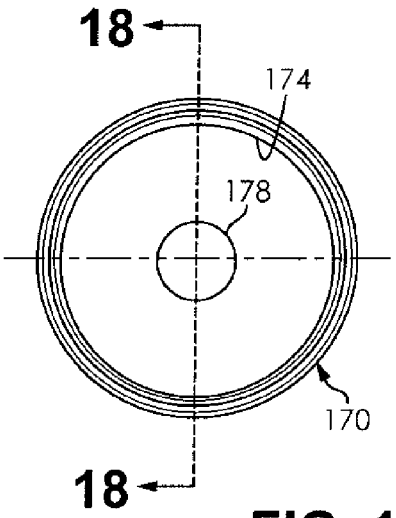
FIG. 17 is a top plan view of a receptacle of the terminal assembly of FIG. 16.
Figure 18:
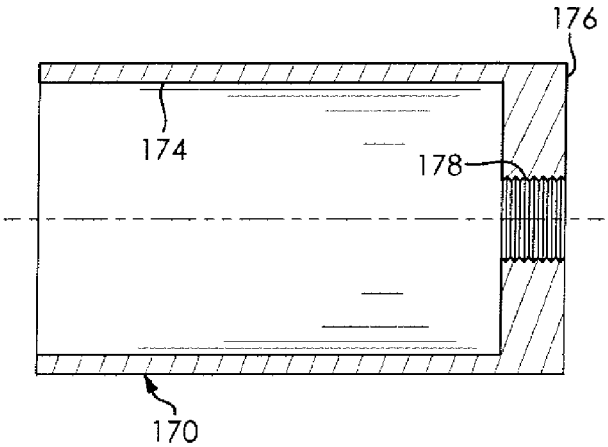
FIG. 18 is a cross-section view of the receptacle taken along line 18-18 of FIG. 17.
Figure 19:
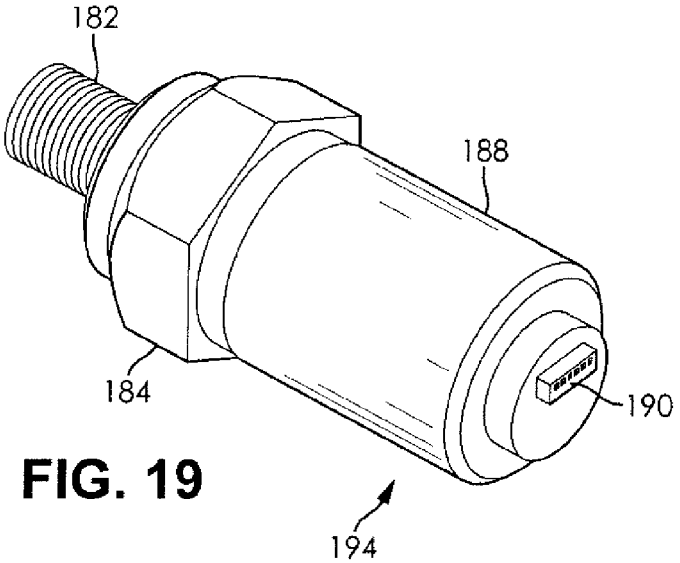
FIG. 19 is a perspective view of a vacuum sensor the terminal assembly of FIG. 16.
Figure 20:
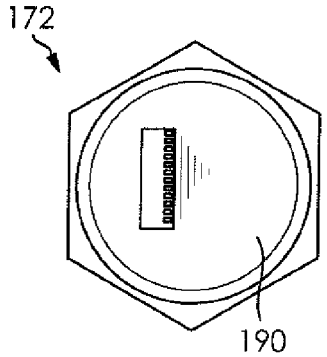
FIG. 20 is a top plan view of the vacuum sensor of FIG. 19.
Figure 21:
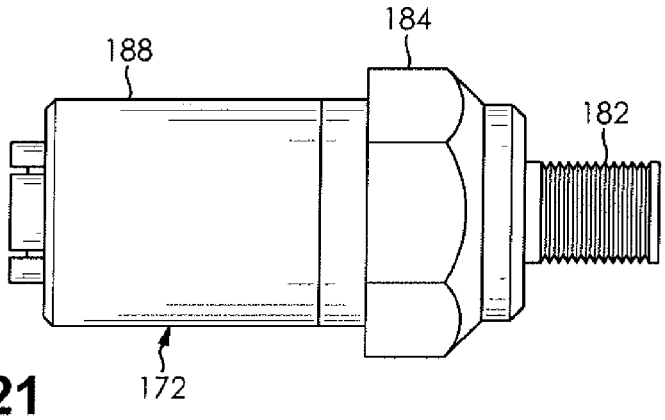
FIG. 21 is a side view of the vacuum sensor of FIGS. 19 and 20.
Figure 22:
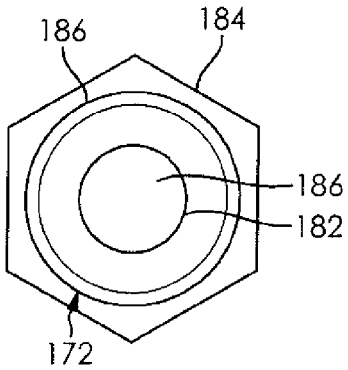
FIG. 22 is a plan bottom view of the vacuum sensor of FIGS. 19 to 21.

As best shown in FIGS. 17 and 18, the illustrated receptacle 170 is generally cylindrical shaped having a central passage 174 therethrough sized and shaped for receiving the sensor 172 therein. An end wall 176 closes the lower end of the passage 174 except for an opening 178 sized and shaped to cooperate with the sensor 172. The illustrated opening 178 is provided with internal pipe threads that cooperate with external threads of the sensor 172. The receptacle 170 is secured to the outer vessel 12 within an opening 180 in the outer vessel 12. The illustrated receptacle 170 is welded to the outer vessel 12 but the receptacle 170 can alternatively be secured in any other suitable manner or formed integral with the outer vessel 12. The illustrated receptacle 170 is formed of stainless steel which can be suitably welded to the stainless steel outer vessel 12 but any other suitable material can alternatively be utilized.

As best shown in FIGS. 19 to 22, the sensor 172 is sized and shaped for receipt within the receptacle 170 and has an externally threaded portion 182 sized and shaped for cooperation with the threaded opening 178 of the receptacle 170 to secure the sensor 172 within the receptacle 170 and to adequately seal the opening 180 in the outer vessel 12 against leaks that would cause a loss of vacuum between the vessels 12, 16. A suitable hex-shaped wrenching portion 184 is provided on the sensor body so that the sensor 172 can be adequately tightened to and untightened from the receptacle 170. The lower end of the sensor 172 is provided with a sensor opening 186 to sense the vacuum within the outer vessel 12 but the body 188 is adequately sealed to prevent the loss of vacuum within the outer vessel 12. The outer end of the sensor 172 is provided with an electrical connector 190 sealed with silicone gel encapsulation. The illustrated sensor 172 provides digital output signals representing the level of vacuum but the sensor 172 can alternatively be of any other suitable type. When the external reader 168 is unattached to the sensor 172, a removable protective cover 192 can be utilized to selectively close the upper open end of the receptacle 170 to prevent the entry of dirt and debris and/or to protect the sensor 172. It is also noted that if the vacuum gauge 172 is not desired, a suitable plug can replace the sensor 172 within the receptacle 170 to adequately seal the threaded opening 178 in the receptacle 170.

The external vacuum gauge reader 168 has an electrical connector 194 that can be selectively connected to electrical connector 190 of the vacuum gauge sensor 172 that energizes and/or communicates with the vacuum gauge sensor 172 to display the level of vacuum within the outer vessel 12. The illustrated reader 168 has a digital display 196 that indicates a numerical value for the vacuum level but it is noted that alternatively any other suitable reading device can be alternatively utilized. Because the external reader 168 is removable, a single external reader 168 can be utilized with more than one cryogenic fluid cylinder 10.

As best shown in FIG. 2, all of the operating controls 30 are located on the top of the outer vessel 12 within the handling ring 22 and are positioned so that all of the operating controls 30 that are typically operated by the customers or end users of the cryogenic fluid cylinder 10 (the liquid-use valve 74, the pressure building valve 56, and the gas-use valve 32) are located on the front side of the outer vessel 12 and all of the operating controls 30 that are intended for use only by the suppliers or maintenance personnel (the economizer regulator 40, the pump-out plug 144, the vacuum gauge port 146, and the vent valve 78) are located on the rear side of the cryogenic fluid cylinder 10. Configured in this manner, it is easier for the customers or end users to reach the operating controls or control devices 30 that they need to operate and it is less likely that the customers or end users will purposely or mistakenly operate an incorrect one the control devices.

The illustrated handling ring 22 is circular when viewed from above and encircles the control devices. The handling ring 22 aids in protecting the cryogenic fluid cylinder 10 and particularly the control devices 30 located thereon upon unintended roll over and makes it easier to walk, roll and move the cryogenic fluid cylinder 10. The illustrated handling ring 22 is lobe shaped having horizontally extending side portions 198 and upwardly curved or convex front and rear portions 200 that extend higher than the side portions 198. Thus, the handling ring 22 is raised higher in the front and rear sides than it is on the lateral sides to provide better access below the handling ring 22 to the control devices 30 located on the top of the cryogenic fluid cylinder 10 at the front and rear sides of the cryogenic fluid cylinder 10. It is noted that while the illustrated handling ring 22 has two raised portions 200, the handling ring 22 could alternatively have a single raised portion such as, for example, a front lobe at the end user controls, or could alternatively have more than two raised portions, such as, for example, three spaced apart raised portion.

The illustrated handling ring 22 is secured to the outer vessel 12 by a pair of ring supports 202 that space the handling ring 22 above each of valves. The illustrated ring supports 202 are only located at lateral sides of the outer vessel 12 and are secured to the horizontal side portions of the handling ring 22. The illustrated handling ring 22 is only attached on the left and right lateral sides so that there is unobstructed access to the valves 32,56, 70, 74, 78 below the handling ring 22 on the front and rear sides of the cryogenic fluid cylinder 10. The handling ring 22 is sized and shaped so that the front and rear portions 200 of the handling ring 22 are high enough to provide access below the handling ring 22 so that the valves 32,56, 70, 74, 78 can be easily operated by directly reaching the valve handles under the handling ring 22 but are low enough that the handling ring 22 still adequately protects the valves 32,56, 70, 74, 78 located on the top of the cryogenic fluid cylinder 10. The illustrated handling ring 22 and side supports 202 are each stainless steel and secured in place by welding but alternatively can be formed of any other suitable material and can alternatively be secured in any other suitable manner.

The illustrated customer or end user control devices (the liquid use valve 74, the pressure building valve 56, and the gas-use valve 32) are each located entirely on the front side of the top of the outer vessel 12. That is, they are all located entirely within a front sector of the top of the outer vessel 12 of 180 degrees. The customer or end user control devices (the liquid use valve 74, the pressure building valve 56, and the gas-use valve 32) are preferably all located entirely within the front raised or lobe portion 202 of the handling ring 22, which in the illustrated embodiment is a front sector of the top of the outer vessel 12 of about 140 degrees. The illustrated customer or end user control devices (the liquid use valve 74, the pressure building valve 56, and the gas-use valve 32) are all located entirely within a front sector of the top of the outer vessel 12 of about 120 degrees. It is noted that the control devices 30 can extend from the manifold 38 at non-normal (that is, non-perpendicular) angles, either in the horizontally and/or vertical direction so that they can be positioned in a more desirable location for access (best shown in FIGS. 5 and 6). In the illustrated embodiment, the gas use valve 32 and the liquid use valve 74 are each angled at acute angles (when viewed from above) to position them closer to the pressure building valve 56.

The supplier or maintenance personnel control devices (the economizer regulator 40, the pump-out plug 144, the vacuum gauge port 146, and the vent valve 78) are all located entirely on the rear side of the top of the outer vessel 12. That is, they are all located entirely within a rear sector of the top of the outer vessel 12 of 180 degrees. The supplier or maintenance personnel control devices (the economizer regulator 40, the pump-out plug 144, the vacuum gauge port 146, and the vent valve 78) are preferably all located entirely within the rear raised or lobe portion 200 of the handling ring 22, which in the illustrated embodiment is a rear sector of the top of the outer vessel 12 of about 140 degrees. The illustrated supplier or maintenance personnel control devices (the economizer regulator 40, the pump-out plug 144, the vacuum gauge port 146, and the vent valve 78) are all located entirely within a rear sector of the top of the outer vessel 12 of about 120 degrees.

The remaining illustrated control devices 30 (the inner vessel pressure gauge 68, the inner vessel pressure relief device 70 and the inner vessel burst disc 72 are also located at rear side of the cryogenic fluid cylinder 10 but it is noted that they can be alternatively located at any other suitable location. The illustrated inner vessel pressure gauge 68 is oriented so that the dial faces forward and a pressure level can be observed from the front side of the cryogenic fluid cylinder 10. The illustrated inner vessel pressure relief device 70 is directed in a horizontal and generally rearward direction so that any release of cryogenic fluid is unlikely to engage anyone standing in front of the cryogenic fluid cylinder. The illustrated inner vessel burst valve 72 is also directed in a generally rearward direction where it is less likely that any persons will be located during normal operating conditions. The illustrated liquid level gauge 76 is centrally located and oriented so that the dial faces forward and the liquid level can be observed from the front side of the cryogenic fluid cylinder 10.

Figure 2A:
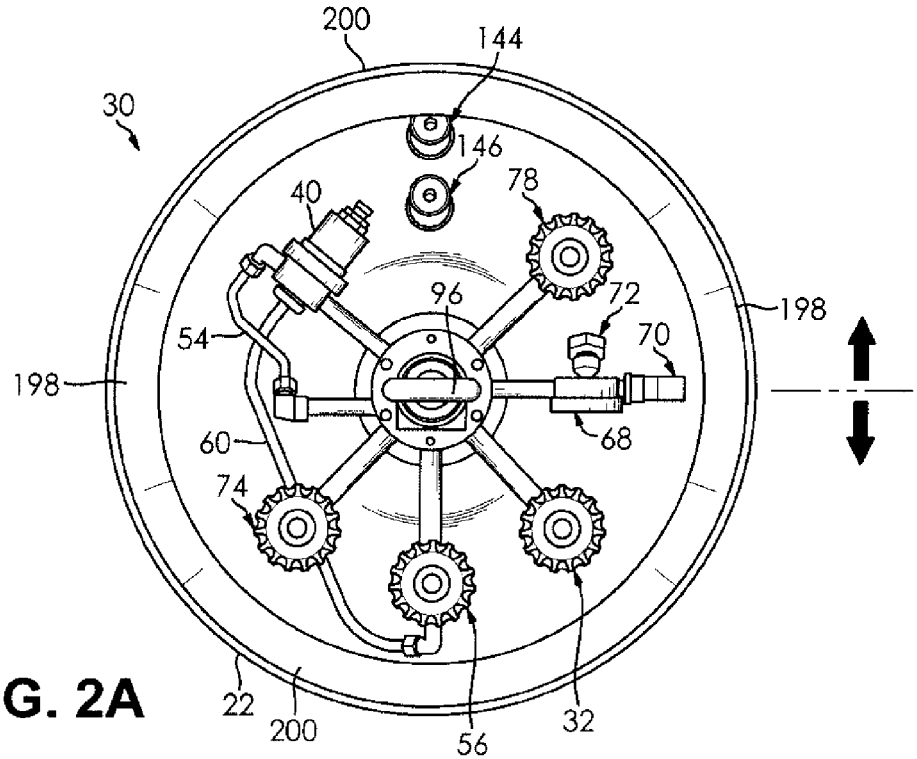
FIG. 2A is a diagrammatic view similar to FIG. 2 but showing an alternative arrangement of the user controls.
Figure 3:
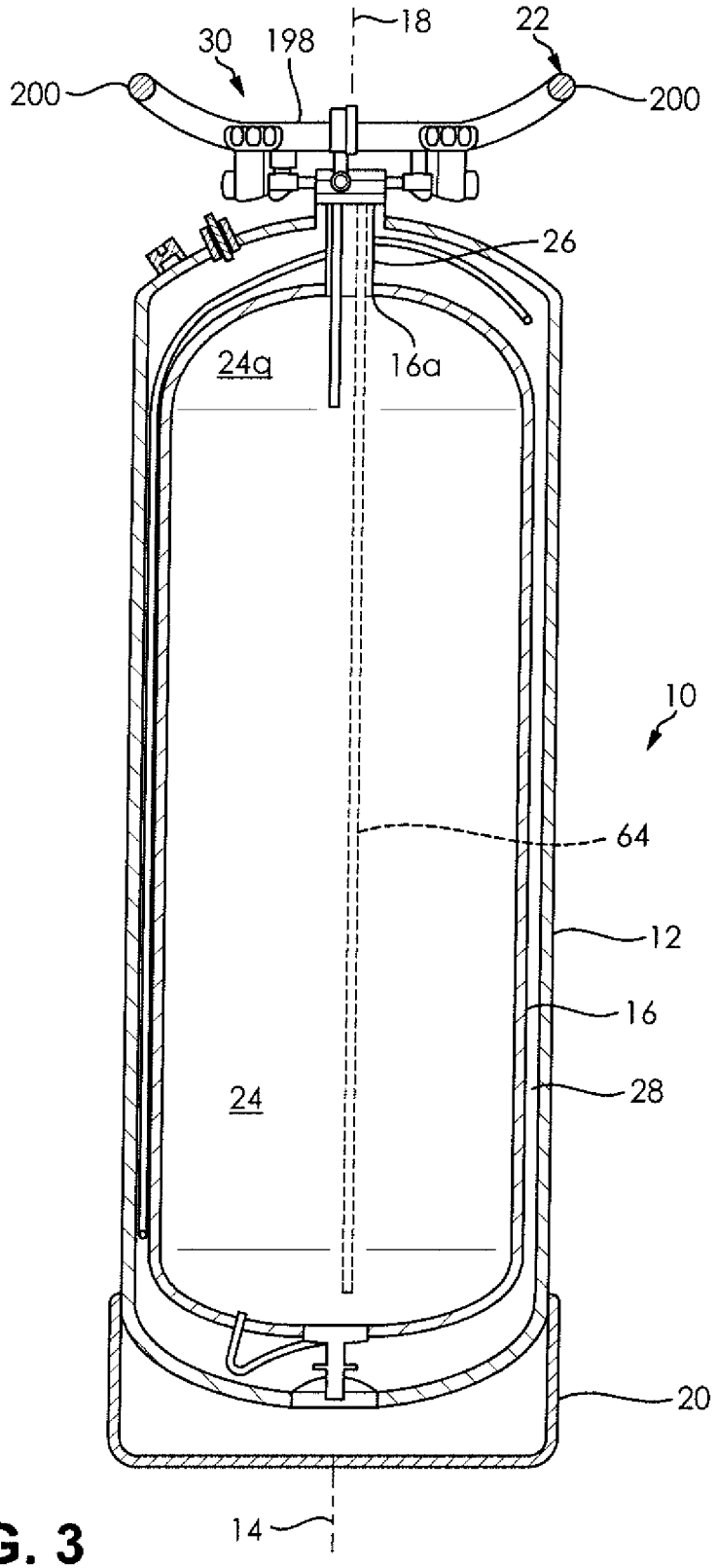
FIG. 3 is a cross-sectional view of the cryogenic fluid cylinder of FIGS. 1 and 2 taken along line 3-3 of FIG. 2.
Figure 4:
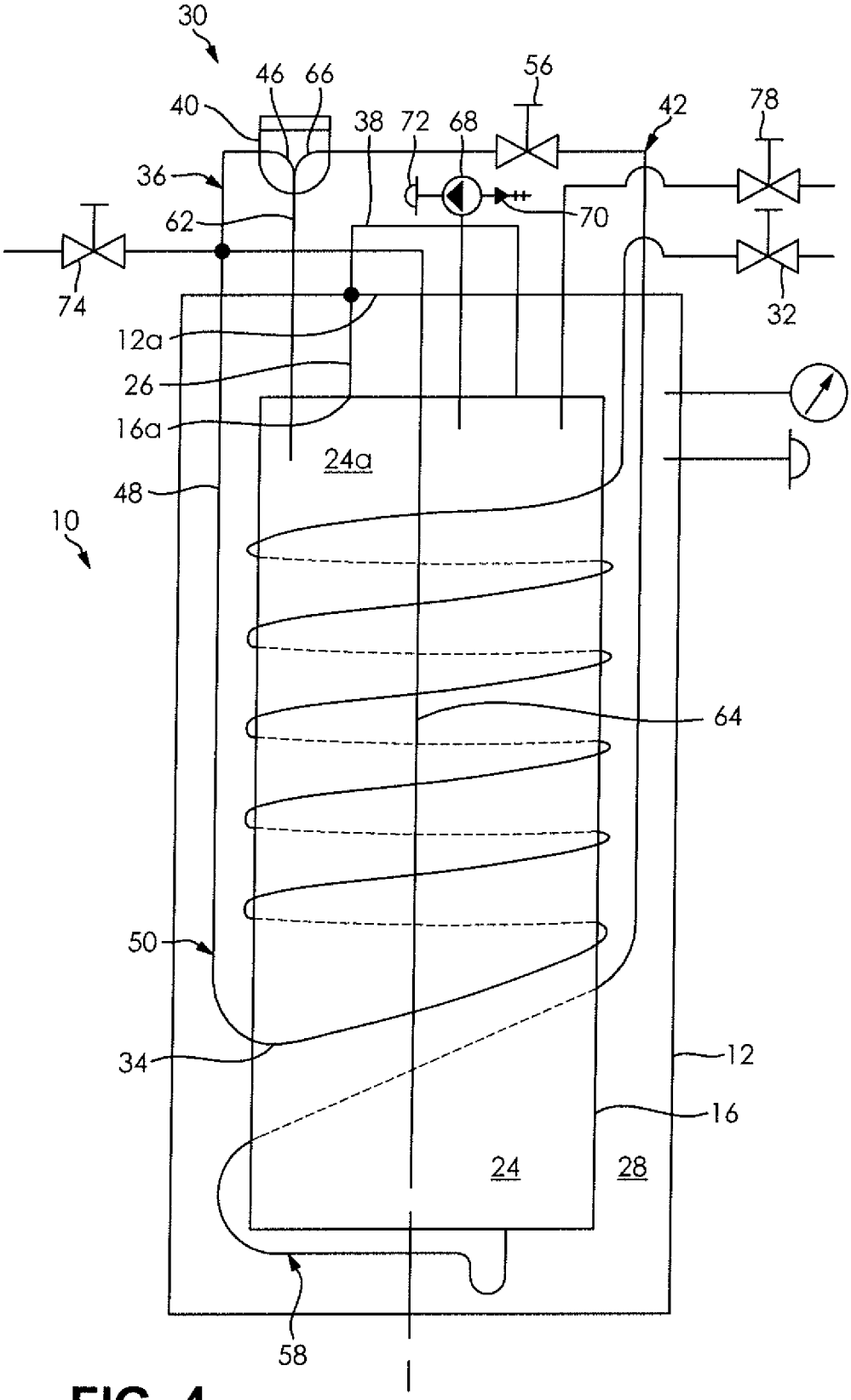
FIG. 4 is a schematic view of the plumbing of the cryogenic fluid cylinder of FIGS. 1 to 3.

FIG. 2A illustrated an alternative user control arrangement of the top of the cryogenic fluid cylinder 10. The user controls are substantially the same as described above but this arrangement shows that the user controls can have other arrangements that separate the customer or end user controls from the suppler or maintenance personnel controls. This arrangement also shows the inner vessel pressure relief device 70 can be oriented so that any release of cryogenic fluid directly engages the handling ring support 202. The illustrated inner vessel pressure relief device 70 is directed in a horizontal and laterally outward direction and is directed directly toward the ring support 202 so that any release of cryogenic fluid directly engages the ring support 202. Such a configuration prevents any person located around the cryogenic fluid cylinder 10 from being directly hit by a sudden release of cryogenic fluid.

It is noted that each of the features and variations of the above disclosed embodiments can be used in any combination with each of the other embodiments.

From the foregoing disclosure it is apparent that the cryogenic fluid containers of the present invention are relatively easy to use and maintain, and are an improvement over prior cryogenic fluid containers.

From the foregoing disclosure and detailed description of certain preferred embodiments, it is also apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A cryogenic fluid container comprising, in combination:

an inner vessel for holding cryogenic fluid;

a cylindrically shaped outer vessel having a vertically extending central longitudinal axis and surrounding the inner vessel and forming an insulating space therebetween;

end user operating controls located on a top of the outer vessel including a liquid-use valve for selectively dispensing liquid cryogen from the inner vessel, a pressure-building valve for selectively controlling a pressure building circuit for increasing pressure within the inner vessel, and a gas-use valve for selectively dispensing gaseous cryogen from the inner vessel;

wherein each of the end user operating controls are located on a front side of the top of the outer vessel;

maintenance operating controls located on the top of the outer vessel including an economizer regulator for selectively setting at least one desired pressure of the inner vessel, a vent valve for selectively venting cryogen fluid from the inner vessel, and a vacuum pressure port for indicating vacuum pressure between the inner and outer vessels;

wherein each of maintenance operating controls are located on a rear side of the top of the outer vessel;

a circular-shaped handling ring secured to the top of the outer vessel and spaced above the end user operating controls and the maintenance operating controls with a pair of ring supports to secure the handling ring to the outer vessel at only lateral sides of the top of the outer vessel to provide unobstructed access to the end user operating controls and the maintenance operating controls below the handling ring on the front and rear sides respectively of the outer vessel; and wherein the handling ring is lobe shaped having horizontally extending side portions and upwardly curved front and rear portions that connect the side portions and extend higher than the side portions.

2. The cryogenic fluid container according to claim 1, wherein each of the end user operating controls are located entirely within a front sector of the top of the outer vessel of about 140 degrees.

3. The cryogenic fluid container according to claim 2, wherein each of the end user operating controls are located entirely within a front sector of the top of the outer vessel of about 120 degrees.

4. The cryogenic fluid container according to claim 1, wherein each of the maintenance operating controls are located entirely within a rear sector of the top of the outer vessel of about 140 degrees.

5. The cryogenic fluid container according to claim 4, wherein each of the maintenance operating controls are located entirely within rear sector of the top of the outer vessel of about 120 degrees.

6. A vertically-oriented cryogenic fluid cylinder comprising, in combination:

an inner vessel for holding cryogenic fluid;

a cylindrically shaped outer vessel having a vertically extending central longitudinal axis and surrounding the inner vessel and forming an insulating space therebetween;

operating controls located on a top of the outer vessel;

a circular-shaped handling ring secured to the top of the outer vessel and encircling the operating controls;

a pair of ring supports securing the circular-shaped handling ring to the outer vessel at only lateral sides of the top of the outer vessel and spacing the circular-shaped ring support above the operating controls; and wherein the circular-shaped handling ring has horizontally-extending side portions and front and rear portions connecting the side portions and at least one of the front portion and the rear portion is raised above the horizontally-extending side portions for providing additional access beneath the circular-shaped handling ring to at least some of the operating controls while protecting the operating controls.

7. The cryogenic fluid container according to claim 6, wherein the circular-shaped handling ring is a lobed ring.

8. The cryogenic fluid container according to claim 6, wherein both of the front portion and the rear portion of the circular-shaped handling ring are raised above the horizontally-extending side portions.

9. The cryogenic fluid container according to claim 6, wherein the front portion is raised above the horizontally-extending side portions.

10. The cryogenic fluid container according to claim 6, wherein the rear portion is raised above the horizontally-extending side portions.

11. A cryogenic fluid container comprising, in combination:

an inner vessel for holding cryogenic fluid;

a cylindrically shaped outer vessel having a vertically extending central longitudinal axis and a wall surrounding the inner vessel and forming an insulating space therebetween;

operating controls located on a top of the outer vessel;

a vacuum gauge port assembly located in the wall of the outer vessel;

wherein the vacuum gauge port assembly includes a receptacle secured to and extending through the wall of the outer vessel and forming an interior cavity having an open outer end and a digital vacuum sensor secured within the interior cavity of the receptacle and having an electrical connector for removable connection of an external vacuum gauge display for indicating vacuum within the insulating space between the inner vessel and the outer vessel; and wherein the digital vacuum sensor is exposed to vacuum in the insulating space between the inner vessel and the outer vessel through an opening in an end wall of the receptacle forming a closed inner end of the receptacle.

12. The cryogenic fluid container according to claim 11, wherein the digital vacuum sensor closes and seals the opening.

13. The cryogenic fluid container according to claim 12, wherein the opening is a threaded opening and the digital vacuum sensor has a threaded portion that cooperates with the threaded opening to removably secure the digital vacuum sensor within the receptacle and to seal the opening.

14. The cryogenic fluid container according to claim 11, wherein the receptacle is partially located within the outer vessel and partially located outside the outer vessel.

* * * * *